US005416940A

United States Patent [19]

Bandera

[11] Patent Number: 5,416,940

[45] Date of Patent: May 23, 1995

[54] MULTIUSE KNIFE FOR THE FUNCTIONING OF MUZZLE-LOADING FIREARMS

[76] Inventor: Carmine Bandera, Via Beata Stefania, 19, 25027 Quinzano d'Oglio (BS), Italy

[21] Appl. No.: 120,457

[22] Filed: Sep. 14, 1993

[30] Foreign Application Priority Data

Oct. 14, 1992 [IT] Italy ..... RM92A0744

[51] Int. Cl.[6] ..... B25F 1/04

[52] U.S. Cl. ..... 7/118; 42/90

[58] Field of Search ..... 7/118; 42/90

[56] References Cited

U.S. PATENT DOCUMENTS 3,600,729 8/1971 Laughlin ..... 7/118

4,817,321 4/1989 Clement .

4,819,289 4/1989 Gibbs .

4,856,132 8/1989 Burns et al. ..... 7/118

5,016,380 5/1991 Jones .

*Primary Examiner*—James G. Smith

*Attorney, Agent, or Firm*—Beveridge, DeGrandi, Weilacher & Young

[57] ABSTRACT

A multiuse knife for faciliating the use and maintenance of muzzle-loading firearms comprising a plurality of tools having blade, prismatic or cylindrical shape, each of which in turn is shaped or realized with a plurality of elements so as to perform a plurality of functions, hinged onto one single handle consisting of small cheeks, folders and blade springs for allowing the housing of the tools and their use at an opening of 90° as well 180° with respect to the axis of the handle.

12 Claims, 3 Drawing Sheets

MULTIUSE KNIFE FOR THE FUNCTIONING OF MUZZLE-LOADING FIREARMS

The present invention concerns a multiuse knife tool that will facilitate the use of muzzle-loading firearms, comprising completely original elements as well as elements having a functioning principle of known kind, all necessary for the use and maintenance of the above mentioned firearms, which consists of a plurality of elements and perform a plurality of functions.

The elements are fixed to a handle by means of pins, in the same way as the elements forming the multiuse knives of Swiss-made kind, but are characteristic for the use only on muzzle-loading firearms; furthermore they are not restricted to the traditional blade-type, but also include some tools having a cylindrical shape and, finally, the elements are able to work when opened at 90° as well as when opened at 180° with respect to the handle's axis.

For loading, the cleaning and the maintenance of a muzzle-loading firearm it is necessary to perform a plurality of operations that require the use of a plurality of elements appositely provided for these purposes.

Such tools, as e.g. for cleaning the wick-holder, for inserting the ball in the barrel, for unscrewing the wick-holder, for taking off the primer capsule etc. are already well known, but each of them is provided for performing only one of said operations. This means that the user must carry each single tool with all disadvantages deriving therefrom: loss of time for seeking the right tool, possibility of loosing a tool, transport difficulties etc.

For all these reasons, some people thought to insert into one single object various tools necessary for the use of muzzle-loading firearms.

The U.S. Pat. No. 4,817,321 of Clement concerns, e.g., a multiuse tool consisting of different objects having a cylindrical shape and provided for performing some operations for use in muzzle-loading firearms, which tool may be disassembled with various parts being inserted and fixed into the other parts by means of apposite cavities and threadings that reduce the total encumbrance thereof.

However, Clement's device is lacking some required tools, e.g., for the introduction of the ball into the barrel, as well as the tools with a prismatic (or blade shape) and a comfortable handle for the use of such tools.

U.S. Pat. No. 5,016,380 of Jones concerns a multiuse tool mainly comprising objects of known kind, that might be used for the introduction of the ball into the barrel of muzzle-loading firearms in which, once again, the cylindrical body of one of the tools has been exploited for storing and fixing by means of threadings, other tools of cylindrical kind or lengthened shape, like screw-drivers etc.

The device in Jones is lacking some tools of prismatic shape as well as a comfortable handle for the use thereof.

The U.S. Pat. No. 4,819,289 of Gibbs concerns a multiuse knife of the known kind with blade tools, and the only novelty thereof consists in a blade prismatic tool with a shape provided in such a way that it may perform a plurality of functions and that may be used for modern automatic arms.

The multiuse knife in Gibbs does not concern muzzle-loading firearms, and furthermore merely exploits the principle of the Swiss-made multiuse knives, mainly consisting of prismatic tools of a blade and plane kind.

In fact, one of the most difficult problems to solve in the Swiss-made multiuse knives is the one of inserting between blade, or type elements tools, having a cylindrical shape that take more place and therefore have a tendency of increasing the encumbrance of the handle that must house said tools, and cause great problems for the assembly of the folders forming the sections of the handle, as each cylindrical tool should have opposed, on the other side of the handle, another cylindrical tool with the same diameter and therefore with the same thickness.

It is the aim of the present invention to eliminate all above mentioned inconveniences, i.e. to eliminate the use of a plurality of separate and different tools, maintaining the tools of only cylindrical or only blade kind for the muzzle-loading arms.

Another aim of the present invention is to provide a multiuse pocket tool or a tool with a hooking like a pendant provided with a comfortable handle.

It is a further aim of the present invention to insert in such a multiuse tool, tools of blade and cylindrical kind for use in muzzle-loading firearms.

Still another aim of the present invention is to allow the use of the tools which open to an angle of 90° as well as to 180° with respect to the handle's axis so as to allow the user to apply a greater force in the use thereof.

The aims set forth are reached by means of the present invention as it is characterized in the enclosed drawings, and that mainly consists in a multiuse pocket or pendant knife that has the purpose of facilitating the use and the maintenance of muzzle-loading firearms, comprising a plurality of tools of blade as well as of cylindrical kind, necessary for performing loading and maintenance of said arms, each of which in turn consists of a plurality of elements or is shaped in such a way as to be able to perform a plurality of functions.

The tools are fixed by means of pins to a single handle provided with outer portions, with folders and blade springs for their housing and keeping tools in position during use, so that the cylindrical as well as prismatic elements, except the blade, are able to work at an opening of 90° and 180° with respect to the axis of the handle.

The advantages obtained by means of the present invention mainly consist in that one single object that may be carried in a pocket or like a pendant, without dangerous projections, of minimum encumbrance and of comfortable shape, comprises many tools, some of which may in turn consist of a plurality of parts, may have a plurality of shapes for performing a plurality of functions or may be able to work opened at 90° as well as at 180° with respect to the handle's axis.

Therefore, the user is facilitated in the transport of the tools as well as in availability of a plurality of tools and in the use thereof, saving space and time in the search of the appropriate tool.

The present invention will be described more in detail hereinbelow according to the enclosed drawings in which a preferred embodiment is shown.

Figure 1:
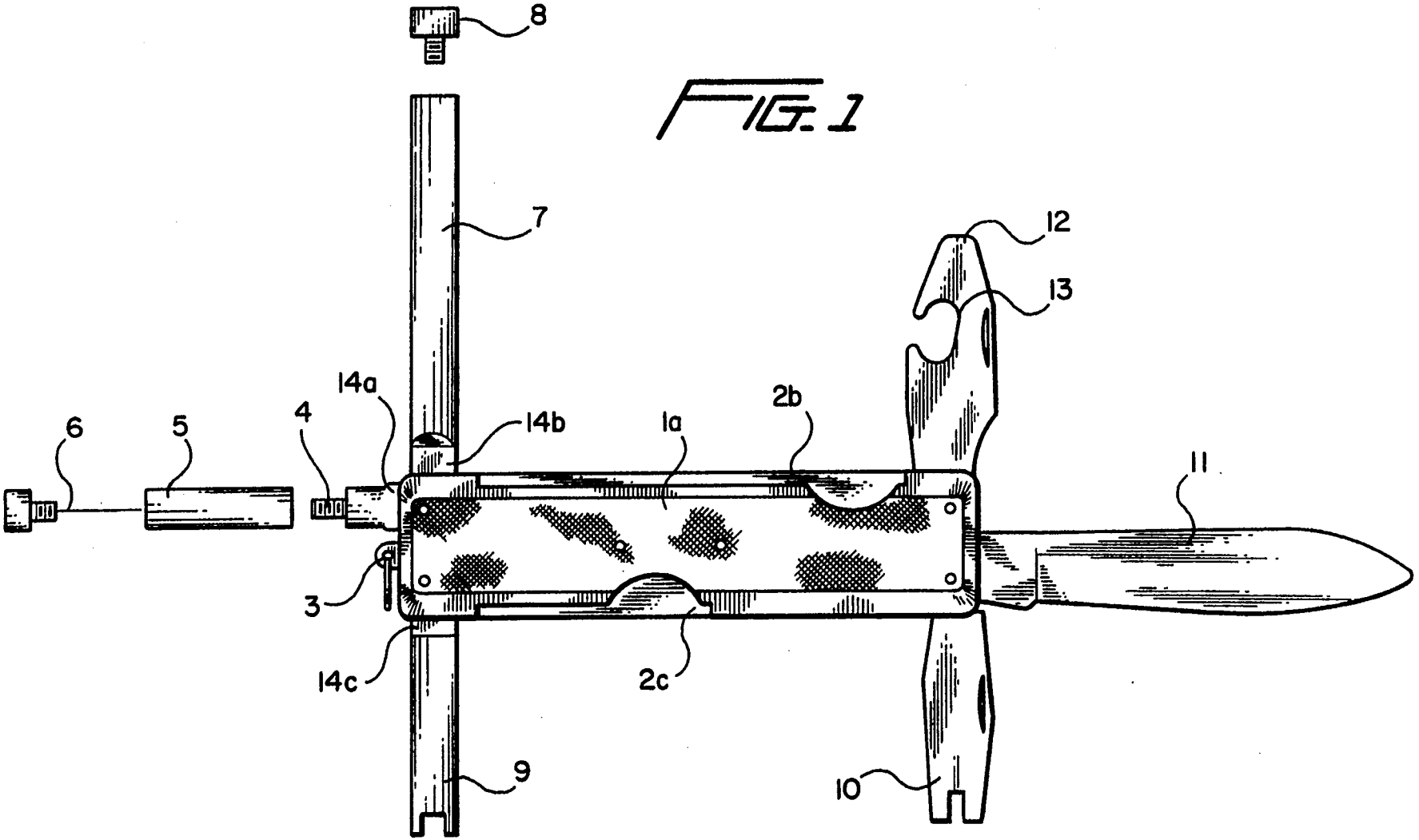
FIG. 1 shows a lateral and partially exploded view of the multiuse knife according to the present invention, in which the tools are shown rotated in an external position with respect to their own seat provided inside the handle, and some of these tools, consisting of a plurality of elements, are shown in an exploded view of the different elements.
Figure 2:
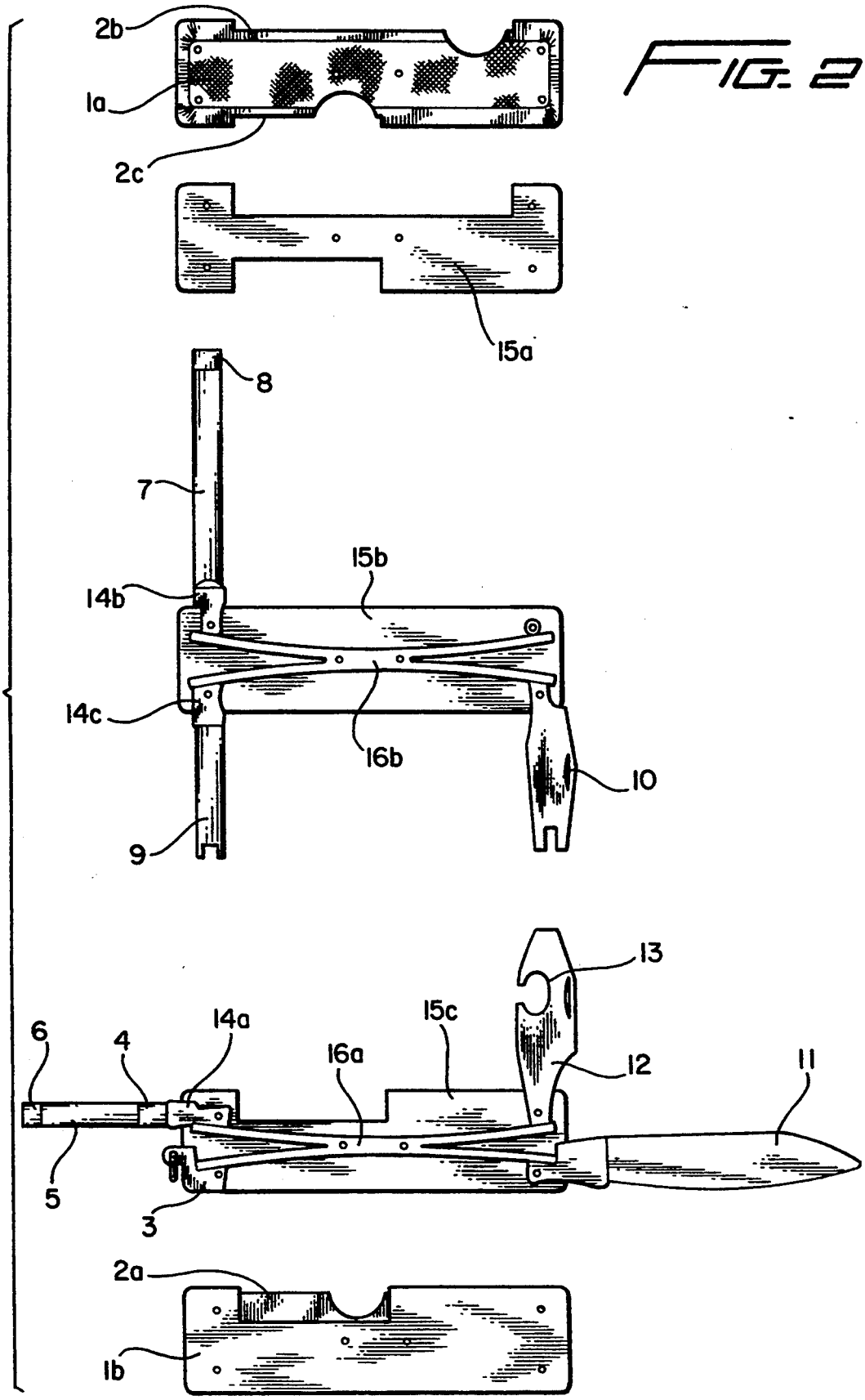
FIG. 2 shows an exploded view of all elements forming the multiuse knife according to the present invention.
Figure 3:
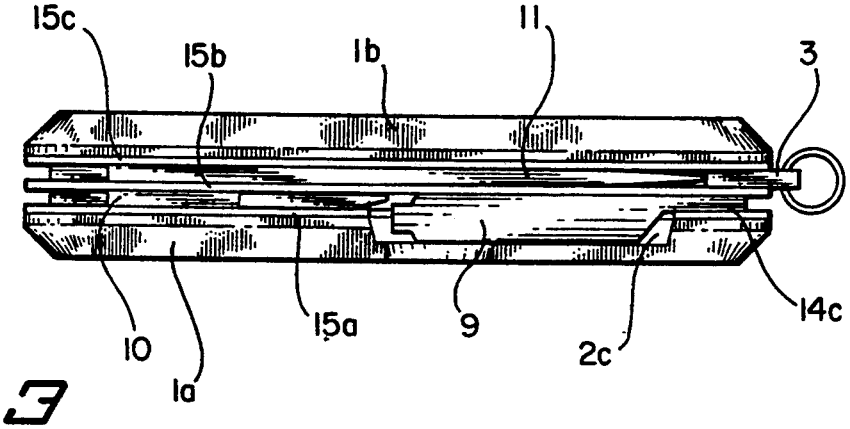
FIG. 3 shows a top view of the multiuse knife according to the present invention.
Figure 4:
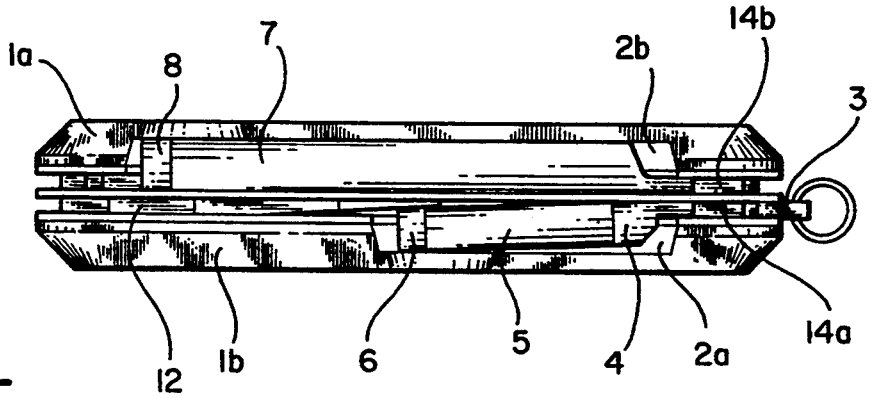
FIG. 4 shows a bottom view of the multiuse knife according to the present invention.
Figure 5:
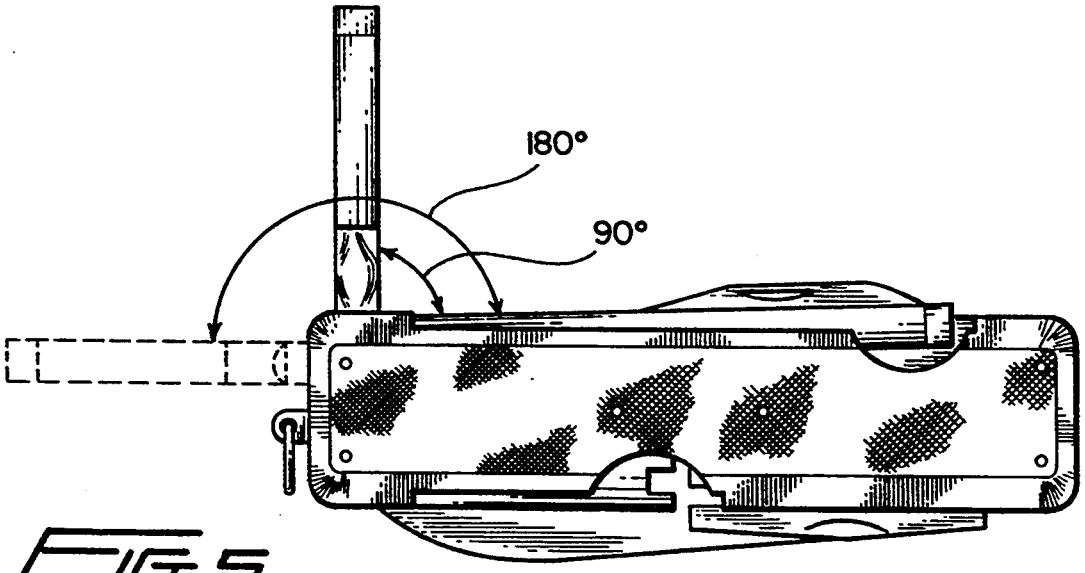
FIG. 5 shows a lateral view of the multiuse knife according to the present invention, with a cylindrical tool that is able to work when opened at 90° and at 180° with respect to the handle's axis.

Relating now to the details of the figures, the multiuse knife according to the present invention consists of:

- two outer portions 1*a* and 1*b* forming the handle and provided with housings 2*a*, 2*b* and 2*c* for 9; receiving the cylindric-shaped tools 4, 5, 6, 7–8 and
- a projection 3 provided with a hole and with a ring for hooking said multiuse knife like a pendant;
- a threaded small cylinder 4 to which a ramrod with a cleaner may be screwed for cleaning the inside of the arms' barrel;
- a pin 6 for the cleaning of the wick-holder;
- a cylindrical tool 7 being internally hollow and closed at the end by a screw-tap 8;
- a cylindrical key 9 for screwing or unscrewing the wick-holder;
- a tool 10 for taking off the primer capsules and the small key that fixes the arm's barrel to the wooden gunstock;
- a blade 11 of known kind;
- a tool 12 shaped like a screwdriver and with an eyelet 13 for taking off the small key;
- three inner plates 15*a*, 15*b* and 15*c* for the internal separation of the spaces provided for the single tools;
- two blade springs 16*a* and 16*b* with four arms.

According to the present invention, the two outer portions 1*a* and 1*b* form the handle of the multiuse knife and respectively have housings 2*b*, 2*c* and 2*a* provided therein in the form of appropriate milled cavities for housing the tools having a cylindrical shape 7–8, 9 and 4-5-6. This avoids any need of increasing the existing space between inner plates 15*a*, 15*b* and 15*c* and keeps the width of the handle of the multiuse knife narrow and provides housing, on sides opposite of the cylindrical tools, for the tools of the blade-kind. Whereby said last feature is made possible also by the fact that the mounted ends 14*a*, 14*b* and 14*c* of the cylindrical tools have a plate, and therefore may be fixed to the handle by means of a pin.

The projection 3 provided with a hole is fixed to the handle of the multiuse knife and is provided with a ring of the known kind for hooking like a pendant.

The cylindrical tool consisting of elements 4-5-6 is already known for its general function, as it has the main task of allowing the insertion of a lead ball into the barrel of a muzzle-loading firearm, but its new form allows it to perform further functions. In fact, the small threaded cylinder 4, hinged in the handle with the plate-shaped end part 14*a*, allows for the attachment of ramrods provided with cleaners for the internal cleaning of the arms. The hollow and internally threaded cylindrical body 5 is provided for protecting the pin for cleaning the wick-holder fixed to the cylindrical head 6 and is able, with its external plane surface, to push the lead ball inside the barrel as well as to allow the screwing to the small threaded cylinder 4.

Also the cylindrical tool consisting of elements 7 and 8 is known in its general shape and function, as it may be used for pushing the lead ball, already inserted with the help of the cylindrical tool consisting of elements 4-5-6, deeper into the barrel, but the new realization thereof allows said tool also the function of housing inside the same some primer capsules for the arm, as it consists of a cylindrical, internally hollow body 7 that is closed at the upper end by a screw tap 8 with an external plane surface, fixed to the handle with its prismatic end part 14*b* by means of a pin joint.

The plate shaped or blade tool 10 is new for its shape as well as for its function; in fact, it has a rectangular cavity on its top that has two wedge-shaped tapered projections that facilitate removal of used primers from the wick-holder and removal of the small key for fixing the barrel to the wooden gunstock of the arm.

The tool 11 is a blade of known kind.

The tool 12 is of plate shaped kind and due to its particular shape it may be used for unscrewing the screws of the arm because its end is a screwdriver, as well as for taking off the small key through the eyelet 13, in alternative to the use of tool 10.

All tools, except the blade 11, are able to work opened at 90° as well as 180° with respect to the axis of the handle, due to the particular shape of their plate shaped end hinged to the handle and kept in position by means of the ends of two blade springs 16*a* and 16*b*.

I claim:

1. A folding multi-tool device for use with a muzzle-loading firearm comprising:

a handle which includes a first and a second outer portion, first, second, and third intermediate portions, and a first and second multi-leaf blade spring, said handle being arranged in a sandwich structure and held together with a plurality of pins, wherein said first outer portion is located next to said first intermediate portion which is located next to said first blade spring which is located next to said second intermediate portion which is located next to said second blade spring which is located next to said third intermediate portion which is located next to said second outer portion;

a threaded cylinder having a threaded first end and a second end;

a first hollow cylindrical ramrod tool having a first end and a second end, said second end being connectable to said threaded first end of said threaded cylinder;

a second hollow cylindrical ramrod tool having a first end and a second end, said second ramrod tool being longer than said first ramrod tool;

a cylindrical wick-holder securing and removal tool having a first end and a second end;

a plate shaped primer remover tool;

a plate shaped screwdriver tool having an eyelet formed therein; and a knife blade;

wherein said second ends of said second ramrod tool and said threaded cylinder, and said wick-holder securing and removal tool, each have a plate shape which is mounted between intermediate portions of said handle, said mounted ends being pivotably fixed within said handle by a respective pin and further being in contact with a corresponding leaf of said blade spring;

said plate shaped tools and said knife blade being dimensioned for mounting between intermediate portions of said handle, wherein a mounted end of each is pivotably fixed within said handle by a respective pin and is in contact with a corresponding leaf of said blade spring;

said outer portions and said first and third intermediate portions having recessed portions formed therein, said recessed portions corresponding to and being dimensioned and arranged for ensconcing said cylindrical tools when said cylindrical tools are folded into a closed position within said handle;

said blade spring leaves urging a corresponding tool to be secured in a position which orients said tool in a closed position, at a position which orients said tool at 90 degrees with respect to a longitudinal axis of said handle, and at a position which orients said tool at 180 degrees with respect to said handle axis.

2. The multi-tool device as claimed in claim 1, wherein:

said first end of said threaded cylinder is capable of receiving a firearm cleaning tool.

3. The multi-tool device as claimed in claim 1, wherein:

said first end of said threaded cylinder is capable of receiving a barrel-length ramrod.

4. The multi-tool device as claimed in claim 1, wherein:

said first end of said first ramrod tool includes a threaded portion capable of receiving a threaded cap on which a wick-holder cleaning pin is mounted, said hollow shaft of said first ramrod tool protecting said cleaning pin when said cap is screwed into the threaded end.

5. The multi-tool device as claimed in claim 4, wherein:

an outer portion of said cap which is opposite said cleaning pin is formed in a shape to facilitate making an initial insertion of a shot into a barrel of said firearm.

6. The multi-tool device as claimed in claim 1, wherein:

said first end of said second ramrod tool includes a threaded portion capable of receiving a cap.

7. The multi-tool device as claimed in claim 1, wherein:

said second ramrod tool is capable of storing primer caps therein.

8. The multi-tool device as claimed in claim 6, wherein:

an outer portion of said cap is formed in a shape to facilitate making a further insertion of a shot into a barrel of said firearm.

9. The multi-tool device as claimed in claim 1, wherein:

said primer removal tool includes a portion for assembling and disassembling a barrel from a stock of said firearm.

10. The multi-tool device as claimed in claim 1, wherein:

said cylindrical and plate shaped tools are appropriately arranged within said handle so as to minimize the thickness of said handle when said tools are in the closed position.

11. The multi-tool device as claimed in claim 1, wherein:

the handle portion includes an outer hole for receiving a pendant hook.

12. The multi-tool device as claimed in claim 1, wherein said mounted ends have notches formed therein which receive end portions of said multi-leaf blade spring.

* * * * *